US005611303A

United States Patent [19]

Izuo

[11] Patent Number: 5,611,303

[45] Date of Patent: Mar. 18, 1997

[54] VALVE OPERATING APPARATUS OF INTERNAL COMBUSTION ENGINE

[75] Inventor: Takashi Izuo, Toyota, Japan

[73] Assignee: Toyota Jidosha Kabushiki Kaisha, Aichi-ken, Japan

[21] Appl. No.: 584,032

[22] Filed: Jan. 11, 1996

[30] Foreign Application Priority Data

Jan. 11, 1995 [JP] Japan ..... 7-002893

[51] Int. Cl.[6] ..... F01L 9/04

[52] U.S. Cl. ..... 123/90.11; 123/90.12; 123/90.14

[58] Field of Search ..... 123/90.11, 90.12, 123/90.13, 90.14

[56] References Cited

U.S. PATENT DOCUMENTS

| | | | |
|---|---|---|---|
| 4,256,065 | 3/1981 | Hirt | 123/90.11 |
| 4,777,915 | 10/1988 | Bonvallet | 123/90.11 |
| 5,131,624 | 7/1992 | Kreuter et al. | 123/90.11 |
| 5,347,961 | 9/1994 | Buehrle, II et al. | 123/90.11 |

FOREIGN PATENT DOCUMENTS

| | | |
|---|---|---|
| 471614 | 2/1992 | European Pat. Off. . |
| 9500959 | 1/1995 | European Pat. Off. . |
| 57-179312 | 11/1982 | Japan . |
| 61-237810 | 10/1986 | Japan . |
| 63-277810 | 11/1988 | Japan . |
| 1-227808 | 9/1989 | Japan . |
| 3-44009 | 2/1991 | Japan . |
| 5-202714 | 8/1993 | Japan . |

OTHER PUBLICATIONS

SAE Paper No.940816, "Control of Engine Load via Electromagnetic Valve Actuators", Mark A. Theobald et al.

*Primary Examiner*—Weilun Lo
*Attorney, Agent, or Firm*—Kenyon & Kenyon

[57] ABSTRACT

A valve operating apparatus includes a biasing unit which applies a biasing force to a valve element so that the valve element is held at a neutral position. A first solenoid coil generates an electromagnetic force to move the valve element in a valve-closing direction. A second solenoid coil generates an electromagnetic force to move the valve element in a valve-opening direction. A stroke-length modifying unit changes a position of the second solenoid coil relative to the first solenoid coil in an axial direction of the valve element in accordance with an operating condition of an engine so that a length of a stroke of the valve element is modified. A neutral-position modifying unit changes the neutral position of the valve element to a new neutral position in accordance with the operating condition of the engine.

8 Claims, 5 Drawing Sheets

VALVE OPERATING APPARATUS OF INTERNAL COMBUSTION ENGINE

BACKGROUND OF THE INVENTION (1) Field of the Invention

The present invention generally relates to a valve operating apparatus of an internal combustion engine, and more particularly to a valve operating apparatus which operates an intake valve or an exhaust valve of an internal combustion engine by using an electromagnetic force.

(2) Description of the Related Art

A conventional valve operating apparatus which operates a valve element (either an intake valve or an exhaust valve of an engine) by using an electromagnetic force is known. For example, Japanese Laid-Open Patent Application No.61-237810 teaches such an apparatus.

The conventional device in the above-mentioned publication includes valve springs which set a plunger at a neutral position by biasing forces of the valve springs. A valve element is fixed to the plunger. When the plunger is at the neutral position, the biasing forces of the valve springs are in an equilibrium condition and the valve element is held at this position. A first solenoid coil generates an electromagnetic force to move the plunger in a valve-closing direction when current is supplied to the first solenoid coil. A second solenoid coil generates an electromagnetic force to move the plunger in a valve-opening direction when current is supplied to the second solenoid coil. A third solenoid coil generates an electromagnetic force to adjust a position of a stem of the valve element in an axial direction of the stem when current is supplied to the third solenoid coil.

The above-mentioned device can move the valve element in the valve-opening direction or in the valve-closing direction from the neutral position by supplying current to the first or second solenoid coil. Also, the above-mentioned device can adjust the neutral position of the plunger by controlling the current supplied to the third solenoid coil.

If the neutral position of the plunger is modified to a new position near the valve-closing end, it is possible to hold the valve element in a valve-closed condition by supplying a small quantity of current to the first solenoid coil. If the neutral position of the plunger is modified to another new position near the valve-opening end, it is possible to hold the valve element in a valve-opened condition by supplying a small quantity of current to the second solenoid coil.

The above-mentioned device can perform the valve opening and closing operations with a reduction of electric power consumption by modifying the neutral position of the plunger. For example, when a required period for the valve-closed condition of the valve element is relatively long, the neutral position of the plunger is adjusted nearer to the valve-closed end to reduce the electric power consumption. When a required period for the valve-opened condition of the valve element is relatively long, the neutral position of the plunger is adjusted nearer to the valve-opened end to reduce the electric power consumption.

However, a required length of the stroke of the valve element of the engine, or the required period for the valve-opening condition of the intake valve or the exhaust valve of the engine, is not uniform in the whole range of the engine operation. In order to provide the engine with a desired level of the intake air, it is desirable to make the stroke of the valve element when the quantity of intake air into the engine is small shorter than the stroke of the valve element when the quantity of intake air is great.

A valve operating apparatus in which the valve element (the intake valve or the exhaust valve) is operated by an electromagnetic force is taken into account. If the stroke of the valve element is longer, the electromagnetic force required to operate the valve element must be increased. To increase the required electromagnetic force, the required electric power consumption must be increased.

Accordingly, in order to ensure a reduction of the electric power consumption in the whole range of the engine operation, it is desirable to provide a valve operating apparatus that is capable of suitably modifying the length of the stroke of the valve element and capable of suitably modifying the neutral position of the valve element.

Although the above conventional device can modify the neutral position of the valve element, it is impossible to modify the length of the stroke of the valve element. Therefore, it is difficult that the above conventional device effectively reduces the electric power consumption in the whole range of the engine operation in order to provide a desired level of output characteristics of the engine.

SUMMARY OF THE INVENTION

An object of the present invention is to provide an improved valve operating apparatus in which the above-described problems are eliminated.

Another object of the present invention is to provide a valve operating apparatus which can suitably modifies the neutral position of the valve element to a new position in accordance with an operating condition of the engine and can suitably modifies the length of the stroke of the valve element in accordance with the operating condition of the engine.

The above-mentioned objects of the present invention are achieved by a valve operating apparatus which includes a biasing unit which applies a biasing force to the valve element so that the valve element is held at a neutral position, a first solenoid coil which generates an electromagnetic force to move the valve element in a valve-closing direction, a second solenoid coil which generates an electromagnetic force to move the valve element in a valve-opening direction, a stroke-length modifying unit which changes a position of the second solenoid coil relative to the first solenoid coil in an axial direction of the valve element in accordance with an operating condition of the engine so that a length of a stroke of the valve element is modified, and a neutral-position modifying unit which changes the neutral position of the valve element to a new neutral position in accordance with the operating condition of the engine.

In the valve operating apparatus of the present invention, the biasing force from the biasing unit, the electromagnetic force from the first solenoid coil and the electromagnetic force from the second solenoid coil are exerted on the valve element. When the electromagnetic forces are not generated by the first and second solenoid coils, the valve element is held at the neutral position by the biasing unit. The valve element is moved to its closed position by the first solenoid coil, and moved to its opened position by the second solenoid coil.

The length of the stroke of the valve element is determined by a distance between the first solenoid coil and the second solenoid coil. The position of the second solenoid coil relative to the first solenoid coil is modified by the stroke-length modifying unit, and the opened position of the valve element related to the second solenoid coil is modified. Therefore, the length of the stroke of the valve element is suitably modified by the stroke-length modifying unit. In addition, in the valve operating apparatus of the present invention, the neutral position of the valve element is suitably modified by the neutral-position modifying unit.

BRIEF DESCRIPTION OF THE DRAWINGS

The above and other objects, features and advantages of the present invention will be more apparent from the following detailed description when read in conjunction with the accompanying drawings in which.

DESCRIPTION OF THE PREFERRED EMBODIMENT

A description will now be given of a preferred embodiment of the present invention with reference to the accompanying drawings.

Figure 1:
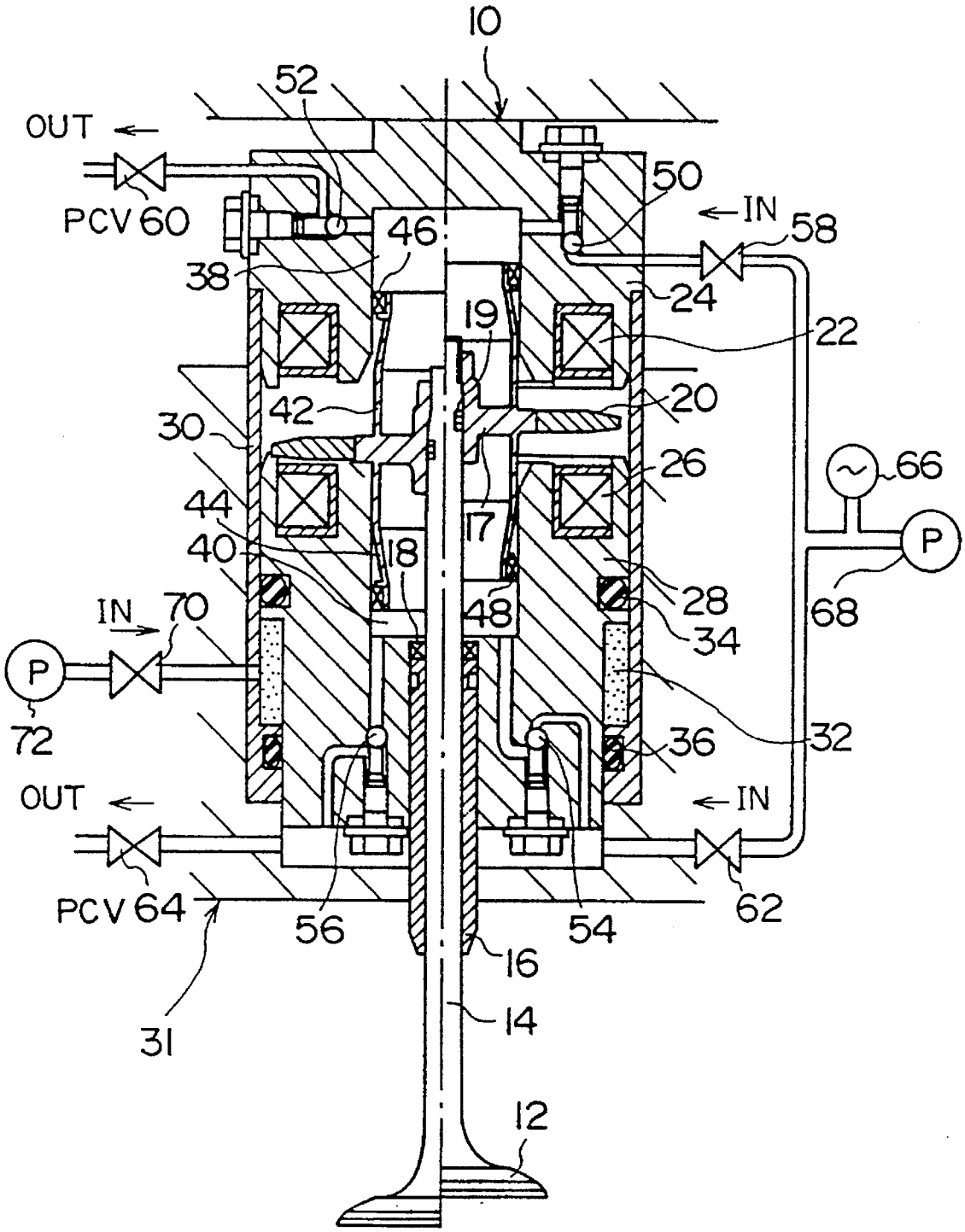
FIG. 1 is a cross-sectional view of a valve operating apparatus in one embodiment of the present invention.

FIG. 1 shows a valve operating apparatus 10 in one embodiment of the present invention.

Referring to FIG. 1, a valve element 12 is provided in a cylinder head 31 so that a lower end of the valve element 12 projects into a combustion chamber of an internal combustion engine. The valve element 12 is representative of either one of intake valves of the engine or one of exhaust valves thereof.

The cylinder head 31 is provided with a plurality of ports. One of the ports has a valve seat which the valve element 12 is engaged to or disengaged from. The opening and closing of the port of the cylinder head 31 is controlled by disengaging the valve element 12 from and engaging the valve element 12 to the valve seat.

A valve stem 14 is integrally formed with the valve element 12. The valve stem 14 is held by a valve guide 16 so that the valve stem 14 is slidable on the valve guide 16 in an axial direction. An upper end of the valve stem 14 is secured to a plunger holder 17.

In the present embodiment, a seal ring 18 is attached to provide an appropriate sealing for an interface between the valve stem 14 and the valve guide 16, and a seal ring 19 is attached to provide an appropriate sealing for an interface between the valve stem 14 and the plunger holder 17.

The plunger holder 17 is made of a non-magnetic material. A plunger 20 is bonded to an outer peripheral portion of the plunger holder 17. The plunger 20 is made of a soft magnetic material.

A first solenoid coil 22 and a first core 24 are disposed above the plunger 20. The first solenoid coil 22 and the first core 24 are spaced apart by a given distance. A second solenoid coil 26 and a second core 28 are disposed below the plunger 20. Similarly, the second solenoid coil 26 and the second core 28 are spaced apart by a given distance.

The first core 24 and the second core 28 are made of a soft magnetic material. The first core 24 is press fitted to an upper end of an outer cylinder 30. The second core 28 is fitted into the inside of the outer cylinder 30 and slidably supported by an internal wall of the outer cylinder 30.

The outer cylinder 30 including the first core 24 and the second core 28 is press fitted to the inside of the cylinder head 31. An end portion of the second core 28 is slidably supported by an internal wall of the cylinder head 31.

An oil chamber 32 is provided between the second core 28 and the outer cylinder 30. The volume of the oil chamber 32 is varied by moving the second solenoid coil 26 relative to the first solenoid coil 22 in an axial direction of the valve element 12. An O-ring 34 is disposed above the oil chamber 32 and an O-ring 36 is disposed below the oil chamber 32 to provide an appropriate sealing for an interface between the second core 28 and the outer cylinder 30.

An air chamber 38 is provided within the first core 24. An air chamber 40 is provided within the second core 28. An upper cylinder 42 which is integrally formed with the plunder holder 17 is provided within the air chamber 38. The upper cylinder 42 is slidably supported by an inside peripheral wall of the air chamber 38. A lower cylinder 44 which is integrally formed with the plunger holder 17 is provided within the air chamber 40. The upper cylinder 42 is slidably supported by an inside peripheral wall of the air chamber 40.

A seal ring 46 is attached to provide an appropriate sealing for an interface between the air chamber 38 and the upper cylinder 42. A seal ring 48 is attached to provide an appropriate sealing for an interface between the air chamber 40 and the lower cylinder 44. Accordingly, the air chambers 38 and 40 are held in an appropriate air-tight condition by the upper and lower cylinders 42 and 44 and the plunger holder 17 with the seal rings 46 and 48.

A check valve 50 is disposed at an intermediate internal portion in an air inlet passage of the first core 24, and a check valve 52 is disposed at an intermediate internal portion in an air outlet passage of the first core 24. The air chamber 38 communicates with the external air supply via this air inlet passage. The check valve 50 is a non-return valve that permits air from an external air supply to flow through the air inlet passage only in its inward direction toward the air chamber 38. The check valve 52 is a non-return valve that permits air from the air chamber 38 to flow through the air outlet passage only in its outward direction toward the atmosphere.

A check valve 54 is disposed at an intermediate internal portion in an air inlet passage of the second core 28, and a check valve 56 is disposed at an intermediate internal portion in an air outlet passage of the second core 28. The air chamber 40 communicates with the external air supply via this air inlet passage. The check valve 54 is a non-return valve that permits air from the external air supply to flow through the air inlet passage only in its inward direction toward the air chamber 40. The check valve 56 is a non-return valve that permits air from the air chamber 40 to flow through the air outlet passage only in its outward direction toward the atmosphere.

Outside the first core 24, a solenoid valve 58 is disposed in the air inlet passage between the check valve 50 and the external air supply, and a pressure control valve (PCV) 60 is disposed in the air outlet passage between the check valve 52 and the atmosphere. The solenoid valve 58 controls the flow of air in the air inlet passage. The PCV 60 controls the pressure of air in the air outlet passage.

Outside the second core 28, a solenoid valve 62 is disposed in the air inlet passage between the check valve 54 and the external air supply, and a pressure control valve (PCV) 64 is disposed in the air outlet passage between the check valve 56 and the atmosphere. An internal space between the bottom of the second core 28 and the cylinder head 31 is shared by the air inlet passage of the second core 28 and the air outlet passage thereof.

The solenoid valves 58 and 62 are electrically operated in response to a control signal from an external control unit. That is, the solenoid valves 58 and 62 are opened or closed in response to the control signal. An accumulator 66 and an air pump 68 are provided at end portions of the air inlet passage from the first core 24. The air pump 68 is the above-mentioned external air supply. The accumulator 66 and the air pump 68 are connected to the solenoid valves 58 and 62 via the air inlet passage.

The pressure control valves (PCVs) 60 and 64 have a variable valve-opening pressure that is determined by a control signal from an external control unit. The PCVs 60 and 64 are at their ends open to the atmosphere. When the pressure of air in each air outlet passage is above the valve-opening pressure, the PCVs 60 and 64 are opened so that the air chambers 38 and 40 are open to the atmosphere. After the PCVs 60 and 64 are opened, the internal pressure of the air chambers 38 and 40 is held below or equal to the valve-opening pressure of the PCVs 60 and 64. When the pressure of air in each air outlet passage is below the determined valve-opening pressure, the PCVs 60 and 64 remain in the closed condition.

In a condition in which the solenoid valves 58 and 62 are opened and the air chambers 38 and 40 are subjected to a discharge air pressure from the air pump 68, the PCV 60 is opened when the pressure of air in the air outlet passage downstream of the check valve 52 is above the valve-opening pressure of the PCV 60. After the PCV 60 is opened, the internal pressure of the air chamber 38 becomes equal to or is held below the valve-opening pressure of the PCV 60. Also, in the above-mentioned condition, the PCV 64 is opened when the pressure of air in the air outlet passage downstream of the check valve 56 is above the valve-opening pressure of the PCV 64. After the PCV 64 is opened, the internal pressure of the air chamber 40 becomes equal to or is held below the valve-opening pressure of the PCV 64. Therefore, if the valve-opening pressures of the PCVs 60 and 64 are modified by using the external control unit, it is possible to modify the internal pressure of the air chambers 38 and 40.

In a case in which the valve-opening pressures of the PCVs 60 and 64 are different from each other, a difference between the internal pressures of the air chambers 38 and 40 may temporarily take place in the above-mentioned condition. After such a transient condition, the plunger holder 17 and the cylinders 42 and 44 will be moved from a high-pressure end to a low-pressure end. The internal pressures of the air chambers 38 and 40 finally become equal to a lower one of the valve-opening pressures of the PCVs 60 and 64.

A hydraulic pump 72 is disposed at one end of an oil passage outside the second core 28, the oil passage being connected at the other end to the above-described oil chamber 32. A solenoid valve 70 is disposed at an intermediate portion of the oil passage. The oil chamber 32 communicates with the hydraulic pump 72 via the solenoid valve 70.

The solenoid valve 70 is similar to the above solenoid valves 58 and 62. That is, the solenoid valve 70 is opened or closed in response to a control signal from an external control unit. The hydraulic pump 72 is a variable-capacity pump having a variable discharge oil pressure which is determined by a control signal from an external control unit.

When the solenoid valve 70 is opened, the internal pressure of the oil chamber 32 is subjected to the discharge oil pressure of the hydraulic pump 72. If the discharge oil pressure of the hydraulic pump 72 is modified to an increased level of discharge oil pressure, the second solenoid coil 26 (and the second core 28) is lifted relative to the first solenoid coil 22 (and the first core 24) so that the volume of the oil chamber 32 expands. If the discharge oil pressure of the hydraulic pump 72 is modified to a lowered level of discharge oil pressure, the second solenoid coil 26 (and the second core 28) is lowered relative to the first solenoid coil 22 (and the first core 24) so that the volume of the oil chamber 32 is reduced.

Next, a description will be given of an operation of the valve operating apparatus 10 in the present embodiment of the present invention.

In the above-described valve operating apparatus 10, when current is supplied to the first solenoid coil 22, a magnetic field inside and outside the coil 22 is produced. Thus, when current is supplied to the first solenoid coil 22, the first solenoid coil 22, associated with the first core 24 and the plunger 20, generates an electromagnetic force to move the plunger 20 upward relative to the outer cylinder 30. Thereby, the valve closing operation of the valve element 12 is performed.

On the other hand, when current is supplied to the second solenoid coil 26, a magnetic field inside and outside the coil 26 is produced. Thus, when current is supplied to the second solenoid coil 26, the second solenoid coil 26, associated with the second core 28 and the plunger 20, generates an electromagnetic force to move the plunger 20 downward relative to the outer cylinder 30. Thereby, the valve opening operation of the valve element 12 is performed.

Accordingly, by supplying current to one of the first solenoid coil 22 and the second solenoid coil 26 alternately, the valve operating apparatus 10 can lift and lower the plunger 20 in a reciprocating manner. Thus, the valve operating apparatus 10 can perform the valve opening and closing operations of the valve element 12.

When the plunger 20 is moved up or down relative to the outer cylinder 30, an operating force F due to the electromagnetic force of the coil 22 or 26 acts on the plunger 20 in a direction to approach a neutral position (or an equilibrium position) of the plunger 20. Obviously, the operating force F acts on the plunger holder 17 as well as the plunger 20. Consequently, the volume of each of the air chambers 38 and 40 is changed in accordance with the movement of the plunger 20.

Generally, a value of the operating force F is represented as follows.

$$F=2S\cdot Po\ \{Vol/(Vo-S\cdot L)\}^{R} \quad (1)$$

where S is a cross-sectional area of the cylinders 42 and 44, Po is an initial internal pressure of the air chambers 38 and 40, Vo is an initial volume of the air chambers 38 and 40, L is a stroke of the valve element 12, and R is a ratio of specific heat capacities.

Taking into account the relationship between the stroke L and the operating force F, an approximation of the magnitude of the operating force F is possible. An approximate value of the operating force F is represented as follows.

$$F=K\cdot L \quad (2)$$

where K is an air spring constant.

For the purpose of analyzing the relationship between the stroke and the operating force, the approximate value of the operating force F by the above Equation (2) is used. In order to suitably control the stroke of the valve element, it is necessary to take into account the value of the air spring constant, which will be explained later.

In a case in which the valve element 12 is operated by the valve operating apparatus 10, the movement of the moving part (including the valve element 12, the plunger 20 and other elements) is considered equivalent to a simple harmonic motion of a spring-mass system. A friction loss due to the sliding movement of the valve element 12 is ignored in this case.

As it is assumed that the movement of the moving part is a simple harmonic motion, a transition time (response time) t of the moving part needed to be moved from one end to the other end is represented as follows.

$$t=\pi\sqrt{(M/K)} \quad (3)$$

where M is a mass of the moving part.

In order to increase the speed of the response of the valve opening and closing by the valve operating apparatus 10 so as to follow high-speed revolutions of the engine, it is necessary to reduce the above transition time t. It is found that in order to reduce the above transition time t, it is necessary to make the mass M of the moving part smaller. It is found that, if the mass M of the moving part is constant, it is necessary to make the air spring constant K greater in order to reduce the transition time t.

Figure 2:
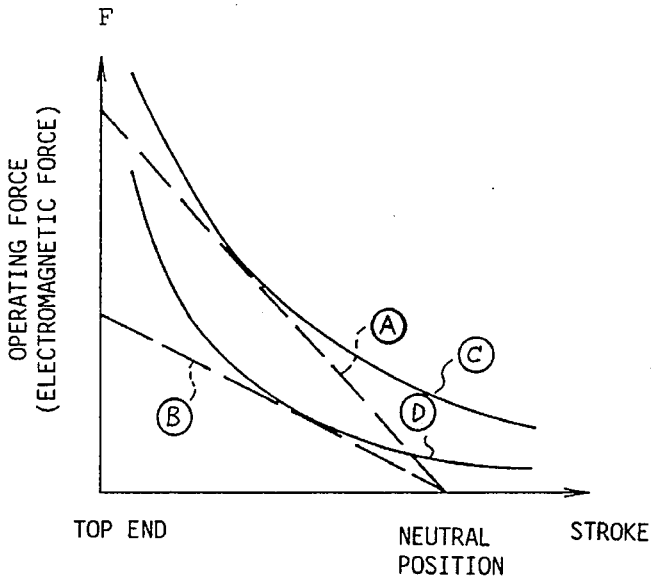
FIG. 2 is a chart showing a characteristic of the stroke versus the operating force and a characteristic of the stroke versus the electromagnetic force when a valve element is moved between the top end and the neutral position.

FIG. 2 shows a stroke vs. operating force characteristic of the valve element 12 and a stroke vs. electromagnetic force characteristic of the valve element 12 when the valve element 12 is moved between the top end and the neutral position.

Referring to FIG. 2, a stroke vs. operating force characteristic in a case in which the air spring constant K is relatively great is indicated by a dotted line "A", and a stroke vs. operating force characteristic in a case in which the air spring constant K is relatively small is indicated by a dotted line "B". As shown in FIG. 2, the gradient of the line "A" is greater than the gradient of the line "B".

It is found that, in order to move the valve element 12 from the neutral position to the top end, the first solenoid coil 22 must generate an electromagnetic force that is always greater than the operating force F indicated by the line "A" or the line "B". Thus, from this point of view, it is necessary to determine the required quantity of current which must be supplied to the first solenoid coil 22.

Accordingly, a stroke vs. electromagnetic force characteristic in the case of a great air spring constant K (the line "A") is indicated by a solid line "C" in FIG. 2, and a stroke vs. electromagnetic force characteristic in the case of a small air spring constant K (the line "B") is indicated by a solid line "D" in FIG. 2. As shown in FIG. 2, the electromagnetic force in the former case (the line "C") is always greater than that in the latter case (the line "D").

Therefore, it is found that the required quantity of current for the first solenoid coil 22 in the case of a small air spring constant K is smaller than that in the case of a great air spring constant K. Also, it is found that a valve operating apparatus with a smaller air spring constant K is advantageous for reducing the electric power consumption.

As described above, in the valve operating apparatus 10 in the present embodiment, the valve-opening pressures of the pressure control valves 60 and 64 can be modified by using an external control unit. If the valve-opening pressures of the PCVs 60 and 64 are modified, the internal pressure Po of the air chambers 38 and 40 are changed. Therefore, the value of the air spring constant K of the valve operating apparatus 10 is modified in accordance with the modifications of the valve-operating pressures of the PCVs 60 and 64.

Thus, in the valve operating apparatus 10 of the present invention, the value of the air spring constant K can be modified by using the external control unit. The air spring constant K is increased when the engine is operated at high-speed revolutions wherein a high-speed response of the valve opening and closing by the apparatus 10 is desired. The air spring constant K is lowered when the engine is operated at low-speed revolutions wherein a high-speed response of the valve opening and closing by the apparatus 10 is not desired. For this reason, the valve operating apparatus 10 of the present invention makes it possible to ensure a desired speed of the response with the electric power consumption being effectively reduced.

Figure 3:
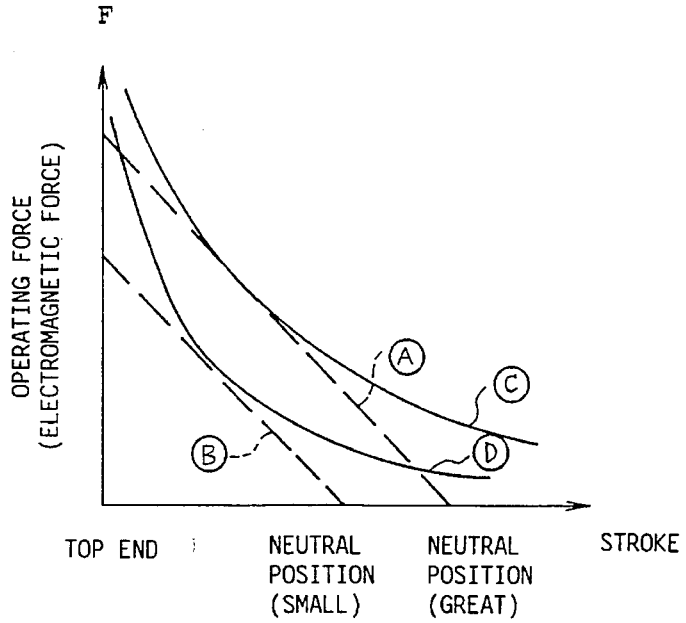
FIG. 3 is a chart showing a characteristic of the stroke versus the operating force and a characteristic of the stroke versus the electromagnetic force when a valve element is moved between the top end and a modified neutral position.

FIG. 3 shows a stroke vs. operating force characteristic of the valve element 12 and a stroke vs. electromagnetic characteristic of the valve element 12 when the valve element 12 is moved between the top end and a modified neutral position.

Referring to FIG. 3, a stroke vs. operating force characteristic in a case in which the distance between the top end and a modified neutral position with respect to the valve element 12 is relatively great is indicated by a dotted line "A", and a stroke vs. operating force characteristic in a case in which the distance between the top end and another modified neutral position with respect to the valve element 12 is relatively small is indicated by a dotted line "B". In both cases of the lines "A" and "B" the air spring constant K is the same As described above, in order to move the valve element 12 from the neutral position to the top end, it is necessary that the valve operating apparatus 10 generate an electromagnetic force that is greater than the operating force F indicated by the line "A" or the line A stroke vs. electromagnetic force characteristic in the case of the line "A" is indicated by a solid line "C" in FIG. 3, and a stroke vs. electro-magnetic force characteristic in the case of the line "B" is indicated by a solid line "D" in FIG. 3.

As the length of the stroke in the case of the line "A" is greater than the length of the stroke in the case of the line "B", the operating force F needed to move the valve element 12 to the top end in the former case must be greater than that in the latter case. As it is apparent from the characteristics in the cases of the lines "C" and "D", the required quantity of current for the first solenoid coil 22 in the case of the line "D" is smaller than that in the case of the line "C". Thus, it is found that a valve operating apparatus with a smaller length of the stroke is advantageous for reducing the electric power consumption.

As described above, in the valve operating apparatus 10 in the present embodiment, the volume of the oil chamber 32 can be modified by controlling the discharge oil pressure of the hydraulic pump 72. If the volume of the oil chamber 32 is modified, the second solenoid coil 26 and the second core 28 are lifted or lowered relative to the first solenoid coil 22 and the first core 24 so that the distance between the first solenoid coil 22 and the second solenoid coil 26 is modified.

The length of the stroke of the valve element 12 is a maximum distance that the plunger 20 can be moved up and down, and this distance is equivalent to the distance between the first solenoid coil 22 and the second solenoid coil 26. Therefore, if the volume of the oil chamber 32 is modified, the length of the stroke of the valve element 12 is modified accordingly.

Thus, in the valve operating apparatus 10 of the present invention, the length of the stroke of the valve element 12 can be modified by controlling the discharge oil pressure of the hydraulic pump 72. The length of the stroke is increased when the engine is operated under a condition in which a large quantity of intake air supplied to the engine is desired. The length of the stroke is reduced when the engine is operated under a condition in which a large quantity of intake air supplied to the engine is not desired. Accordingly, the valve operating apparatus 10 of the present invention makes it possible to ensure a desired output characteristic of the engine and an effective reduction of the electric power consumption of the apparatus 10.

If the length of the stroke of the valve element 12 is modified without correcting the neutral position of the plunger 20, the position of the plunger 20 will deviate from a central point between the first core 24 and the second core 28 when the plunger 20 is at the neutral position. If such a deviation occurs, it is necessary to make the required quantity of current for the first solenoid coil 22 and the required quantity of current for the second solenoid coil 26 different from each other. The valve operating apparatus in such a case may experience some difficulty in operating and controlling the valve element 12.

As described above, in the valve operating apparatus 10 in the present embodiment, different valve-opening pressures of the PCVs 60 and 64 can be determined by using the external control unit. Thus, the position of the plunger holder 17 with the cylinders 44 and 46 can be suitably modified.

Accordingly, in the valve operating apparatus 10 of the present invention, when the length of the stroke of the valve element 12 is modified by a change $\delta L$ in the stroke length by a movement of the second solenoid coil 26 relative to the first solenoid coil 22, the position of the plunger holder 17 with the cylinders 44 and 46 is also modified by a distance ($\delta L/2$) that is equal to half the change $\delta L$ in the stroke length. Thus, the valve operating apparatus 10 of the present invention makes it possible to modify the length of the stroke of the valve element 12 with the plunger 20 being always held at the central point between the first core 24 and the second core 28.

Also, in the valve operating apparatus 10 of the present embodiment, the modification of the length of the stroke of the valve element 12 is made by determining different valve-opening pressures of the PCVs 60 and 64. In other words, the length of the stroke is modified by controlling the difference between the air pressures in the air chambers 38 and 40. The difference between the air pressures in the air chambers 38 and 40 is controlled by an air spring which is comprised of the air chambers 38 and 40 and the cylinders 42 and 44. The air spring applies a biasing force to the valve element 12 by using an air pressure so that the valve element 12 is held at the neutral position.

In a case of a valve operating apparatus in which the length of the stroke is modified by using a mechanical coil spring, the mass M of the moving part, included in the above Equation (3), is represented as follows.

$$M=mv+ms/3 \quad (4)$$

where ms is a mass of the coil spring, and mv is a mass of an actually-moving part including the valve element 12, the plunger 20, the plunger holder 17 and other elements.

It is found that the mass of the moving part in a case of the valve operating apparatus 10 in the present embodiment can be reduced from the mass of the moving part in a case of the above-mentioned apparatus with the coil spring by a mass of "ms/3". Further, it is found that the air spring constant K of the valve operating apparatus 10 of the present invention can be set to a value smaller than that of the above-mentioned apparatus with the coil spring, and it is possible to ensure a desired speed of the response of the valve opening and closing operation. Thus, the valve operating apparatus 10 of the present invention is advantageous for the purpose of reducing the electric power consumption.

Figure 4:
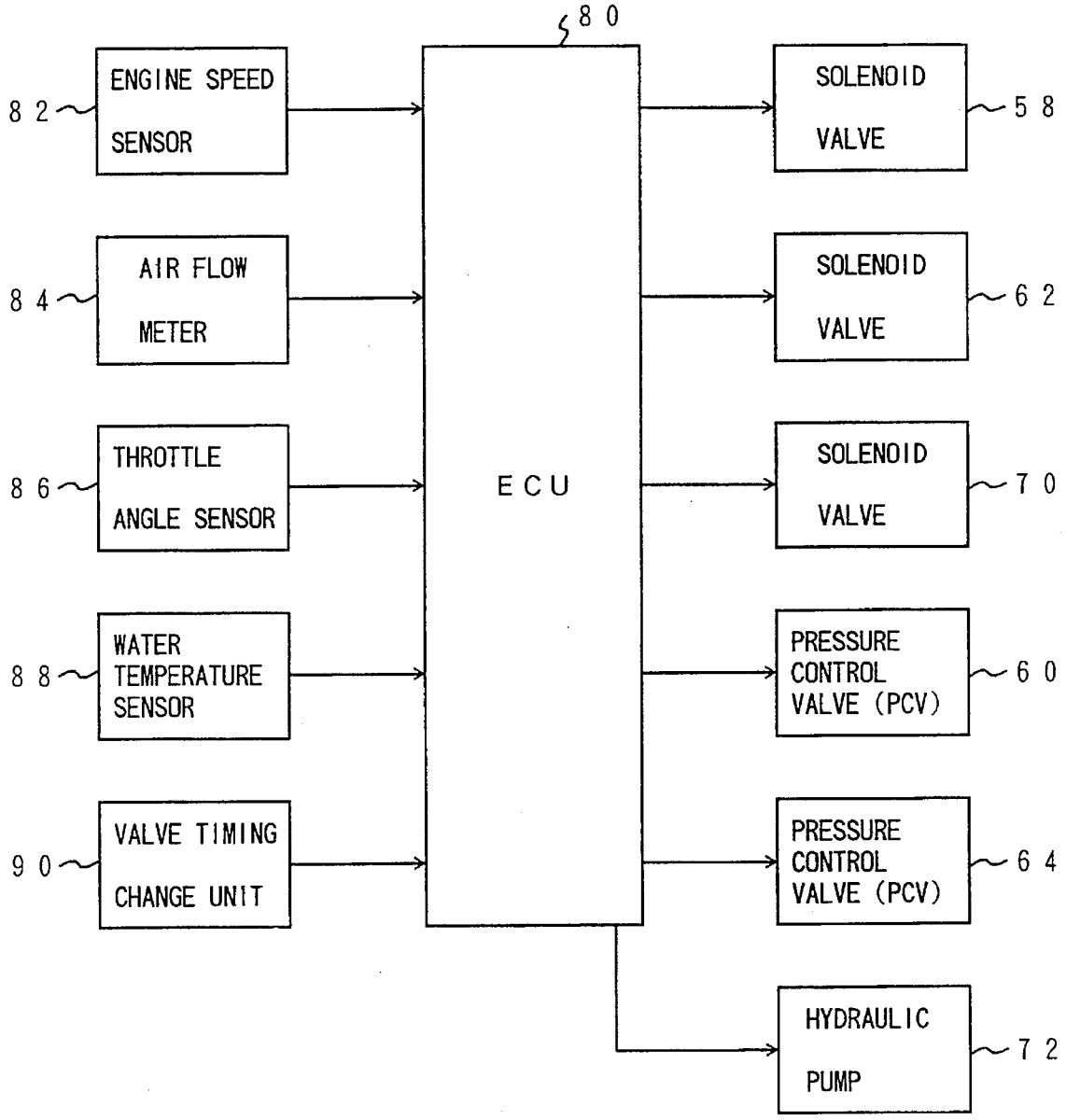
FIG. 4 is a block diagram of a control unit which controls a stroke length of the valve element and controls an air spring constant of the valve operating apparatus.

FIG. 4 shows an electronic control unit (ECU) 80 which controls the stroke length of the valve element 12 as well as the air spring constant K of the valve operating apparatus 10.

Referring to FIG. 4, the electronic control unit (ECU) 80 includes various inputs and various outputs. An engine speed sensor 82 which senses an engine speed (NE) of the engine is connected to one input of the ECU 80. An air flow meter 84 which senses a quantity (flow rate) of intake air into the engine is connected to one input of the ECU 80. A throttle angle sensor 86 which senses an opening angle of a throttle valve is connected to one input of the ECU 80. A water temperature sensor 88 which senses a temperature of engine cooling water in the engine is connected to one input of the ECU 80. A valve timing change unit 90 is connected to one input of the ECU 80. The valve timing change unit 90 issues a command for the ECU 80 to change a combustion cycle of the engine from a 4-stroke mode to a 2-stroke mode, or vice versa, under a predetermined operating condition.

The ECU 80 is comprised of a microcomputer as a main component. The ECU 80 performs a stroke-length and neutral-position determining procedure based on signals sent from the above-mentioned sensors, to control the solenoid valves 58, 62 and 70, the pressure control valves 60 and 64, and the hydraulic pump 72. These elements of the valve operating apparatus 10 are connected to the outputs of the ECU 80.

In addition, the valve timing change unit 90 issues a command for the ECU 80 to change the combustion cycle of the engine from the 4-stroke mode to the 2-stroke mode, or vice versa, in accordance with the operating condition of the engine.

In a case of an engine wherein a combustion chamber is provided above a piston, and an intake valve and an exhaust valve are included in the combustion chamber, the engine of this type is usually operated in the 4-stroke mode. In the 4-stroke mode, the intake valve is opened when the piston is moved from around the top dead center to the bottom dead center (the suction stroke), the intake valve is closed with the exhaust valve being closed when the piston is moved from around the bottom dead center to the top dead center (the compression stroke), the combustion of air-fuel mixture takes place when the piston is moved from around the top dead center to the bottom dead center (the expansion stroke), and the exhaust valve is opened when the piston is moved from around the bottom dead center to the top dead center (the exhaust stroke).

In a case of an engine of another type wherein a super charger is attached and variable-speed intake and exhaust valves are included, the engine can be operated in the 2-stroke mode. In the 2-stroke mode, the intake valve and the exhaust valve are opened each time the piston is moved from around the top dead center to the bottom dead center, and the spark ignition takes place each time the piston reaches around the top dead center. When the piston is moved from around the top dead center to the bottom dead center, air-fuel mixture is forced into the combustion chamber by the super charger to move away the exhaust gas in the combustion chamber.

Generally, the output torque obtained from the engine when it is operated in the 2-stroke mode is greater than when operated in the 4-stroke mode. On the other hand, the fuel economy of the 2-stroke mode operation becomes worse than that of the 4-stroke mode operation. In order to ensure a good output characteristic of the engine when the fuel economy is taken into account, it is desirable to suitably select one of the 4-stroke mode operation and the 2-stroke mode operation as the combustion cycle of the engine in accordance with the operating condition of the engine.

In the case of the above engine wherein the super charger is attached and wherein the valve operating apparatus 10 of the present invention is applied to each of the intake and exhaust valves of the engine, it is possible to ensure a good output characteristic of the engine without considerably reducing the fuel economy by suitably selecting one of the 4-stroke mode operation and the 2-stroke mode operation in accordance with the operating condition of the engine.

The valve timing change unit 90 previous described is provided in order to achieve the above-mentioned purpose. When an operating condition of the engine that requires a great output torque of the engine is detected, the valve timing change unit 90 issues a command for the ECU 80 to change the combustion cycle of the engine from the 4-stroke mode to the 2-stroke mode. On the other hand, when an operating condition of the engine which does not require a great output torque of the engine is detected, the valve timing change unit 90 issues a command for the ECU 80 to change the combustion cycle of the engine from the 2-stroke mode to the 4-stroke mode.

Next, a description will be given of controlling the stroke length of the valve element 12 and controlling the air spring constant of the valve operating apparatus 10.

Figure 5:
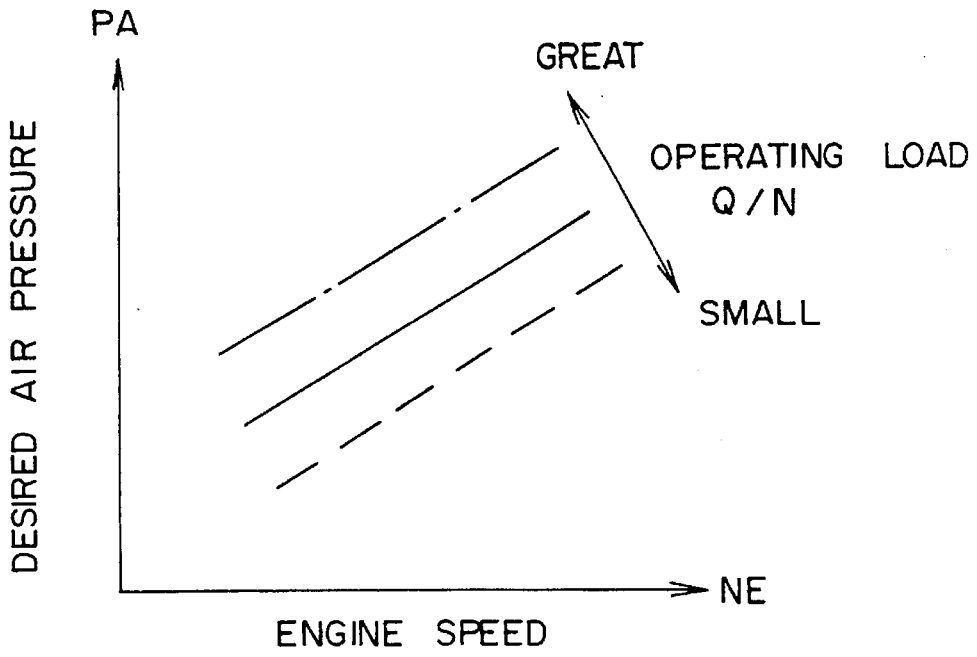
FIG. 5 is a diagram showing a desired air pressure map of the valve operating apparatus.

FIG. 5 shows a desired air pressure map of the valve operating apparatus 10. By making reference to the desired air pressure map shown in FIG. 5, the ECU 80 generates a desired air pressure PA of the air chambers 38 and 40 from the engine speed NE and an operating load Q/N.

As previously described, it is necessary to make the air spring constant K of the valve operating apparatus 10 greater in order to increase the speed of the response of the valve element 12. When the engine is operated under a condition in which a higher engine speed is required, the speed of the response of the valve element 12 must be increased accordingly. Thus, as in the desired air pressure map in FIG. 5, the desired air pressure PA is increased in accordance with the increase of the engine speed NE. The desired air pressure map is a monotonic increasing function of the engine speed NE.

The operating load Q/N indicates a required quantity of intake air for one revolution of the engine. In order to move the valve element (the intake valve or the exhaust valve of the engine) from the valve-closed condition to the valve-opened condition, it is necessary that the valve operating apparatus 10 produce an operating force for opening the valve element 12 that is greater than a force due to a combustion pressure of the combustion chamber of the engine related to the valve element 12.

Generally, the greater the operating load Q/N is, the greater the combustion pressure of the combustion chamber is. Therefore, it is necessary that the valve operating apparatus 10 produce a greater operating force for opening the valve element 12, in accordance with the increase of the operating load Q/N.

In the valve operating apparatus 10, the operating force needed to move the valve element 12 from the valve-closed condition to the valve-opened condition is modified by controlling the air spring constant K. Thus, in the valve operating apparatus 10, the air spring constant K is modified to an increased value in accordance with the increase of the operating load Q/N. If the desired air pressure PA of the air chambers 38 and 40 is increased by modifying the air spring constant K to an increased value in accordance with the increase of the operating load Q/N, it is possible that the value operating apparatus 10 produce the operating force needed for opening the valve element 12 against the increased combustion pressure of the related combustion chamber.

Accordingly, as in the desired air pressure map in FIG. 5, the desired air pressure PA is increased in accordance with the increase of the operating load Q/N. In FIG. 5, maps indicative of relationships between the engine speed NE and the desired air pressure PA which respectively define a small-load case in which the operating load Q/N is relatively small, an intermediate-load case in which the operating load Q/N is intermediate, and a great-load case in which the operating load Q/N is relatively great, are indicated by a dotted line, a solid line and a one-dot chain line.

In the desired air pressure map shown in FIG. 5, the desired air pressure PA is changed to an increased value in accordance with the increase of the engine speed NE, and that the desired air pressure PA is changed to an increased value for the same engine speed in accordance with the increase of the operating load Q/N.

Figure 6:
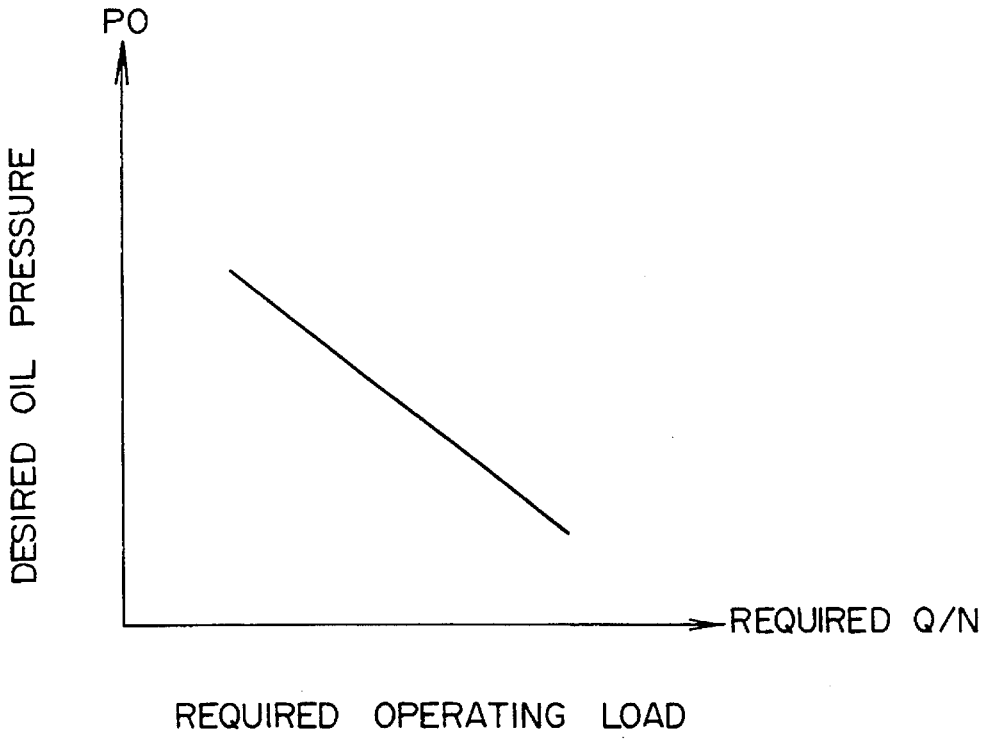
FIG. 6 is a diagram showing a desired oil pressure map of the valve operating apparatus.

FIG. 6 shows a desired oil pressure map of the valve operating apparatus 10. By making reference to the desired oil pressure map shown in FIG. 6, the ECU 80 generates a desired oil pressure Po of the air chamber 32 from a required operating load Q/N (the required Q/N).

As shown in FIG. 6, the desired oil pressure Po is a monotonic decreasing function of the required operating load Q/N. The value of the desired oil pressure Po is defined so as to determine an appropriate length of the stroke of the valve element 12 by the movement of the second solenoid coil 26 relative to the first solenoid coil 22. When the engine is operated under a condition that requires a great quantity of intake air into the engine, it is necessary to make the length of the stroke of the valve element 12 greater. When the engine is operated under a condition that requires a small quantity of intake air into the engine, it is necessary to make the length of the stroke of the valve element 12 smaller.

In the valve operating apparatus 10 of the present invention, the length of the stroke for the valve element 12 is reduced when the internal pressure of the oil chamber 32 is raised. The length of the stroke for the valve element 12 is enlarged when the internal pressure of the oil chamber 30 is lowered. Accordingly, the desired oil pressure map in which the desired oil pressure Po which is a monotonic decreasing function of the required operating load Q/N is defined as shown in FIG. 6.

Figure 7:
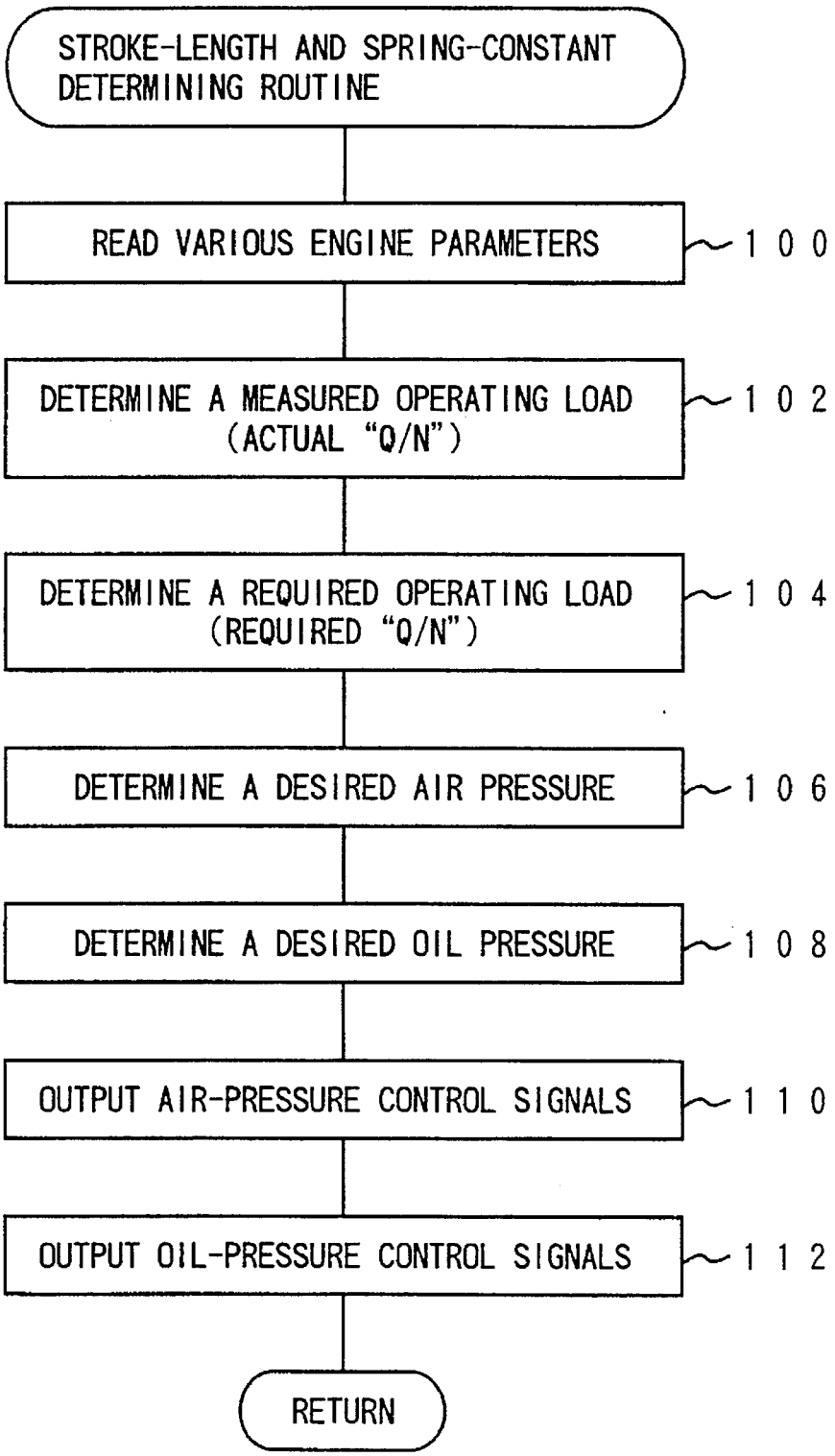
FIG. 7 is a flow chart for explaining a stroke-length and spring-constant determining routine executed by the control unit.

FIG. 7 shows a stroke-length and spring-constant determining routine executed by the electronic control unit 80. The ECU 80 of the valve operating apparatus of the present invention executes this routine in order to suitably control the length of the stroke of the valve element 12 and suitably control the air spring constant of the valve operating apparatus 10.

Referring to FIG. 7, the ECU 80, at step 100, reads various engine parameters which are necessary to carry out the following procedures. In the present embodiment, various signals including a signal indicative of the engine speed (NE) sensed by the engine speed sensor 82, a signal indicative of the intake air quantity (Q) sensed by the air flow meter 84, a signal indicative of the throttle opening angle sensed by the throttle angle sensor 86, a signal indicative of the engine cooling water temperature sensed by the water temperature sensor 88, and a signal indicative of the command issued by the valve timing change unit 90, are read by the ECU 80.

The ECU 80, at step.102, determines a measured operating load (actual Q/N) from the sensed engine speed (NE) and the sensed intake air quantity (Q). The measured operating load indicates a measured quantity of the intake air into the engine for one revolution of the engine.

The ECU 80, at step 104, determines a required operating load (required Q/N) from the sensed engine speed (NE), the sensed throttle opening angle (THA), and the sensed engine cooling water temperature (THW). The required operating load indicates a required quantity of the intake air into the engine for one revolution of the engine.

The ECU 80, at step 106, determines a desired air pressure PA from the sensed engine speed (NE) and the measured operating load (the actual Q/N) by making reference to the desired air pressure map shown in FIG. 5.

In a case in which a 4-stroke mode request command has been issued by the valve timing change unit 90, the ECU 80 determines the desired air pressure PA obtained from the desired air pressure map, without correcting the PA. In a case in which a 2-stroke mode request command has been issued by the valve timing change unit 90, the ECU 80 corrects the desired air pressure PA obtained from the desired air pressure map, so as to make a speed of the response of the valve opening and closing operation by the valve operating apparatus in the 2-stroke mode operation twice as high as that in the 4-stroke mode operation by using a corrected value of the desired air pressure PA.

The ECU 80, at step 108, determines a desired oil pressure Po from the required operating load (the required Q/N) by making reference to the desired oil pressure map shown in FIG. 5. Also, at this step 108, the ECU 80 determines a length change δL of the stroke length for the valve element 12 after the desired oil pressure Po has been applied to the oil chamber 32. That is, the length of the stroke of the valve element 12 is modified by the length change δL, and this length change is equivalent to the movement of the second solenoid coil 26 relative to the first solenoid coil 22.

The ECU 80, at step 110, outputs air-pressure control signals to the solenoid valves 58 and 62 and the pressure control valves (PCVs) 60 and 64, respectively, in accordance with the desired air pressure PA in the above step 106. By outputting the air-pressure control signals to the valves 58, 62, 60 and 64, the internal pressure of the air chambers 38 and 40 is controlled to the desired air pressure PA.

In addition, by outputting the air-pressure control signals to the valves 58, 62, 60 and 64, the neutral position of the valve element 12 is modified to a new position in the direction of the movement of the second core 28 by a distance (δL/2) that is equal to half the length change δL determined in the above step 108. That is, the new neutral position of the valve element 12 after the position of the second solenoid coil 26 relative to the first solenoid coil 22 is changed by the length change δL is located at a central point between the first solenoid coil 22 and the second solenoid coil 26.

The ECU 80, at step 112, outputs oil-pressure control signals to the solenoid valve 70 and the hydraulic pump 72, in accordance with the desired oil pressure Po in the above step 108. By outputting the oil-pressure control signals to the solenoid valve 70 and the hydraulic pump 72, the internal pressure of the oil chamber 32 is controlled to the desired oil pressure Po. As the internal pressure of the oil chamber 32 is modified to the desired oil pressure Po, the position of the second solenoid coil 26 relative to the first solenoid coil 22 is changed, and such a movement of the second solenoid coil 26 is equivalent to the length change δL.

After the above step 112 is performed, the stroke-length and spring-constant determining routine in FIG. 7 ends.

Accordingly, the valve operating apparatus 10 of the present invention can effectively reduce the electric power consumption in the whole range of the engine operation when the valve opening and closing operations of the valve element 12 are performed. The valve operating apparatus of the present invention can provide a desired level of the output characteristics of the engine while the electric power consumption in the whole range of the engine operation is effectively reduced.

In addition, when a 2-stroke mode request command is issued by the valve timing change unit 90 and the stroke-length and spring-constant determining routine in FIG. 7 is executed by the ECU 80, it is necessary to rapidly increase the internal pressure of the air chambers 38 and 40 immediately after the 2-stroke mode request command has been issued. To meet this requirement, in the accumulator 66, compressed air under a predetermined high pressure is accumulated in advance. The compressed air from the accumulator 66 is supplied to the air chambers 38 and 40 via the air inlet passage when the 2-stroke mode request command is issued by the valve timing change unit 80.

In the above-described embodiment, the biasing unit includes the air spring which is comprised of the air chamber 38, the upper cylinder 42, the air chamber 40 and the lower cylinder 44. A fluid pressure applying unit which applies a biasing force to the valve element 12 by using a fluid pressure to hold the valve element at the neutral position, is comprised of these elements. The stroke-length modifying unit is comprised of the oil chamber 32 and the hydraulic pump 72. The neutral-position modifying unit is comprised of the air spring, the air pump 68 and the pressure control valves 60 and 64.

Further, the present invention is not limited to the above-described embodiment, and variations and modifications may be made without departing from the scope of the present invention.

What is claimed is:

1. A valve operating apparatus which operates a valve element of an internal combustion engine comprising:

a biasing unit which applies a biasing force to the valve element so that the valve element is held at a neutral position;

a first solenoid coil which generates an electromagnetic force to move the valve element in a valve-closing direction;

a second solenoid coil which generates an electromagnetic force to move the valve element in a valve-opening direction;

a stroke-length modifying unit which changes a position of said second solenoid coil relative to said first solenoid coil in an axial direction of the valve element in accordance with an operating condition of the engine so that a length of a stroke of the valve element is modified; and a neutral-position modifying unit which changes said neutral position of the valve element to a new neutral position in accordance with the operating condition of the engine.

2. The valve operating apparatus according to claim 1, wherein said biasing unit is a fluid pressure applying unit which applies the biasing force to the valve element by using a fluid pressure.

3. The valve operating apparatus according to claim 1, wherein said biasing unit comprises a first air chamber, an upper cylinder slidably supported by an inside peripheral wall of said first air chamber, a second air chamber, and a lower cylinder slidably supported by an inside peripheral wall of said second air chamber.

4. The valve operating apparatus according to claim 1, wherein said stroke-length modifying unit comprises an oil chamber which is connected to the second solenoid coil, and a hydraulic pump which supplies a discharge oil pressure to the oil chamber, said stroke-length modifying unit changing the position of the second solenoid coil relative to the first solenoid coil by controlling the discharge oil pressure of the hydraulic pump in accordance with the operating condition of the engine and subjecting said oil chamber to said discharge oil pressure.

5. The valve operating apparatus according to claim 1, further comprising an electronic control unit which determines a desired oil pressure from the operating condition of the engine by making reference to a desired oil pressure map, and outputs an oil-pressure control signal to a hydraulic pump in accordance with the desired oil pressure.

6. The valve operating apparatus according to claim 1, wherein said neutral-position modifying unit comprises a first pressure control valve which is connected to a first air chamber, a second pressure control valve which is connected to a second air chamber, and an air pump which supplies a discharge air pressure to said first and second air chambers.

7. The valve operating apparatus according to claim 6, wherein each of said first pressure control valve and said second pressure control valve has a variable valve-opening pressure which is determined by a control signal from an electronic control unit.

8. The valve operating apparatus according to claim 1, further comprising an electronic control unit which determines a desired air pressure from the operating condition of the engine by making reference to a desired air pressure map, and outputs an air-pressure control signal to an air pump in accordance with the desired air pressure.

* * * * *